US007934269B1

(12) United States Patent
Lask et al.

(10) Patent No.: US 7,934,269 B1
(45) Date of Patent: May 3, 2011

(54) METHOD AND ARTICLE OF CLOTHING FOR PATIENTS RECEIVING MEDICAL TREATMENT

(76) Inventors: Charles M. Lask, Highland Park, IL (US); Merle B. Lask, Highland Park, IL (US)

( * ) Notice: Subject to any disclaimer, the term of this patent is extended or adjusted under 35 U.S.C. 154(b) by 0 days.

(21) Appl. No.: 12/134,027

(22) Filed: Jun. 5, 2008

(51) Int. Cl.
*A41B 9/00* (2006.01)

(52) U.S. Cl. ..... 2/114; 2/69; 2/96

(58) Field of Classification Search ..... 2/114, 113, 2/115, 106, 105, 108, 80, 79, 75, 83, 118, 2/119, 1, 104, 96
See application file for complete search history.

(56) References Cited

U.S. PATENT DOCUMENTS 5,621,917 A * 4/1997 Howsden ..... 2/111
5,991,923 A * 11/1999 Maria ..... 2/83
6,216,270 B1 * 4/2001 Moquin et al. ..... 2/69
6,314,580 B1 * 11/2001 Greenberg et al. ..... 2/108
6,792,622 B2 * 9/2004 Graves ..... 2/114
7,198,614 B2 4/2007 Kappauf

* cited by examiner

*Primary Examiner* — Gloria Hale
(74) *Attorney, Agent, or Firm* — McDonnell Boehnen Hulbert & Berghoff LLP

(57) ABSTRACT

The present invention is directed to an article of clothing and a method for accessing a portion of a patient's body for treatment that permit an area of treatment to remain substantially covered. In one embodiment, a shirt/jacket is provided that has a first closeable opening in the front of the shirt/jacket that extends from the bottom of the shirt/jacket to the top of the collar or neckline and a second closeable opening extending from the outer cuff of a sleeve to the neckline at the outer top side of the collar. The second closeable opening is preferably opened and closed by a hook and loop fastener. This permits tubing to be routed through the second closeable opening to be attached to an intravenous access device in a patient's arm and for the shirt sleeve to remain substantially closed and cover the patient even when treatment is being provided to the arm. In another embodiment, the shirt/jacket includes an additional closable opening that extends from the top of the neckline or collar to a point in the chest area of the shirt/jacket and where the closable opening is preferably opened and closed by a hook and loop fastener. This permits tubing to be routed through the additional closable opening to be attached to an intravenous access device in a patient's chest and for the shirt to remain substantially closed and cover the patient even when treatment is being provided to the chest area.

16 Claims, 3 Drawing Sheets

METHOD AND ARTICLE OF CLOTHING FOR PATIENTS RECEIVING MEDICAL TREATMENT

FIELD OF THE INVENTION

This invention is in the field of clothing and, more particularly, relates to clothing and methods of using such for patients receiving medical treatment.

BACKGROUND OF THE INVENTION

Many medical treatments, especially in a hospital or clinic setting, require that the healthcare providers have access to sites of the patient's body. For example, it is often necessary to deliver drugs, medication, fluids and/or nutrition supplementation intravenously to the patient. Typically such delivery is done through an intravenous access device that is connected to a location on the patient's body (oftentimes somewhere on the patient's arm or chest). It is also often necessary to access areas of the patient's body to monitor the patient's health. There are many types of intravenous access devices. Certain types of medication, such as chemotherapy, are often delivered intravenously to the patient via intravenous access devices designed to be used for a prolonged period of time, such as a peripherally inserted central catheter (known as a PICC or PIC line). PICC lines are often inserted in a patient's arm. Chemotherapy can also be delivered by other intravenous access devices, such as a Hickman line inserted in the patient's chest. Some intravenous access devices (often called ports or porta-caths) are implanted subcutaneously and do not have an external connector. Medication, fluids and/or nutrition supplementation can be delivered continuously (an intravenous drip) or intermittently. A patient may have more than one intravenous access device connected to different locations of his/her body.

Because of the need to regular access at least one site on the patient, in a hospital or clinic setting patients typically are often required to take off articles of clothing. This frequent and repeated occurrence causes discomfort to the patient and is cumbersome for the healthcare provider. Even if it is not necessary to remove clothing entirely, regular clothing interferes with the healthcare provider's ability to easily and quickly access areas of the patient's body. In addition, when a patient needs to remove his or her shirt, a healthcare provider may need to remove whatever drug delivery devices may be connected to an intravenous access device inserted in the patient's arm or chest and then reconnect those devices after the patient changes his or her shirt. Alternatively, the patient could wear limited clothing, but this will cause discomfort due to the cool temperatures of a hospital or clinic setting. Also, not wearing clothing may not be socially acceptable and have a negative impact on the patient's self esteem.

Some have attempted to design clothing to allow a healthcare provider easier access to a particular location of the patient's anatomy. For example, U.S. Pat. No. 7,198,614, entitled "Method and Apparatus for Adapting Clothing to Allow Access For Medical Procedures," discloses a method and apparatus for positioning and creating an opening in a person's shirt or blouse at a location that varies depending on the underlying location necessary to perform a medical procedure. The patent discloses creating such an opening to allow access to a porta-cath without requiring the patient to remove his or her shirt or blouse.

The invention disclosed in U.S. Pat. No. 7,198,614 still requires the drug delivery device connected to the porta-cath to be disconnected in the event the patient's shirt or blouse needs to be removed. The disclosure requires a custom modification of a particular patient's shirt or blouse. In addition, the shirt disclosed in that patent causes a portion of the patient's body to be substantially uncovered by clothing. It is therefore still desirable to create clothing that will be more flexible in terms of allowing a healthcare provider easier access to different parts of the patient's anatomy and that does not require custom modification. It is also still desirable to create clothing that will permit the area of treatment to remain substantially covered even when treatment is being administered. It is also still desirable to create clothing that can be removed without requiring a healthcare provider to disconnect one or more drug delivery devices. It is also desirable to create a method for accessing an area on a patient's body for treatment while permitting the patient continue to wear comfortable clothing.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE PRESENTLY PREFERRED EMBODIMENTS

The preferred embodiment(s) of the present invention is a shirt, sweatshirt or jacket that enhances the comfort of a patient receiving medical treatment and that allows healthcare providers easier access to a location on a patient's body for treatment and, in particular, for accessing an area for providing intravenous delivery of drugs, medication, fluids and/or nutrition supplements. The preferred embodiment(s) also permit a healthcare provider to more easily access areas of a patient's body for the purpose of monitoring the patient. For example, there is often a need to access a patient's arm to check his/her blood pressure, a patient's chest to listen to his/her breathing and/or heartbeat, etc. The following description is presented to enable a person of ordinary skill in the art to make, use and practice the invention, and is provided in the context of a particular application and its requirements. Various modifications to the preferred embodiment(s) will be readily apparent to those skilled in the art, and the generic principles defined herein may be applied to other embodiments and applications without departing from the spirit and scope of the invention. Thus, the present invention is not intended to be limited to the embodiment(s) shown, but is to be accorded the widest scope consistent with the principles and features disclosed herein.

Figure 1:
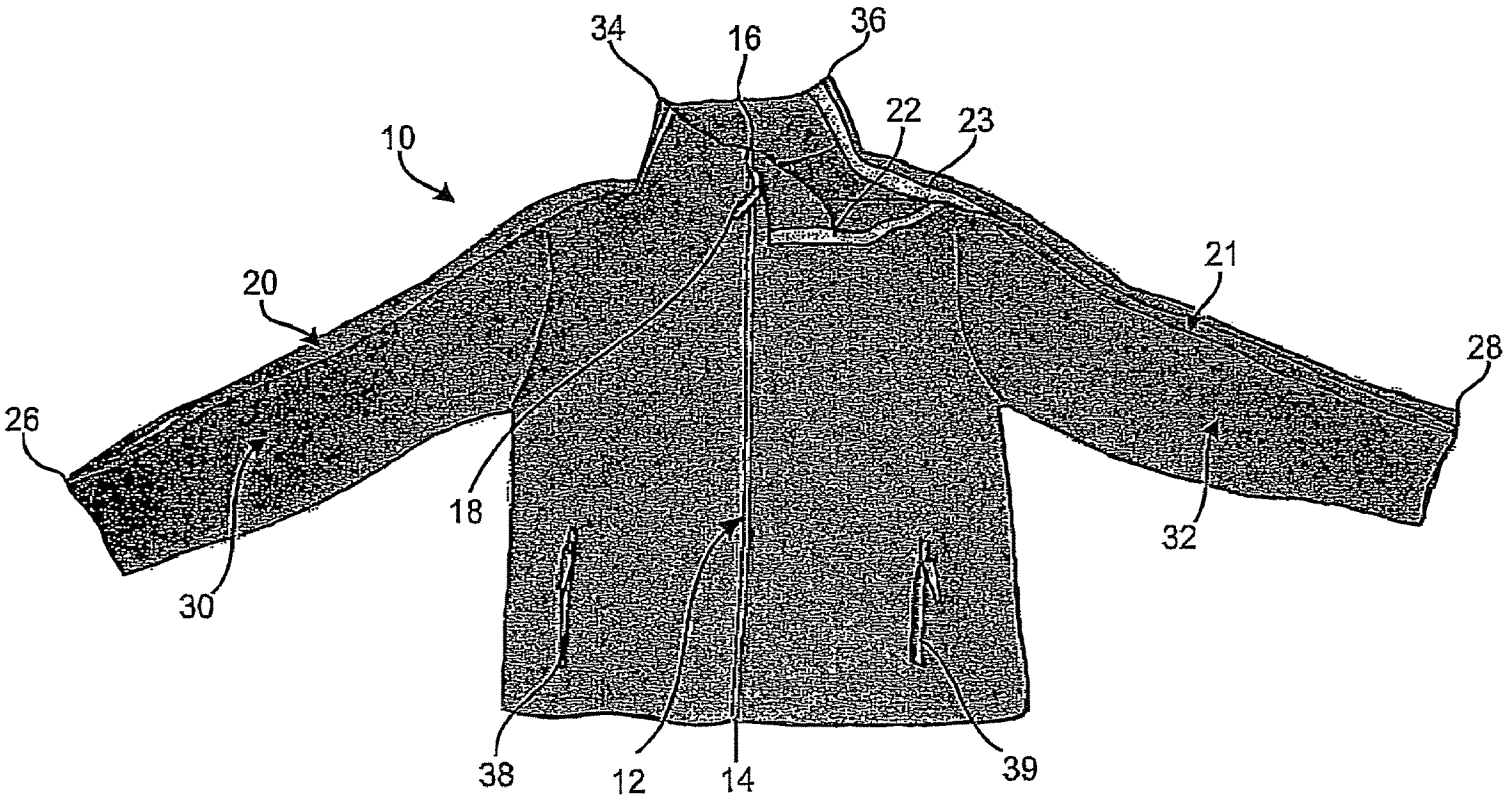
FIG. 1 shows a front view of a shirt embodying a preferred embodiment of the invention.

In one embodiment, as shown in FIG. 1, a long sleeve shirt or jacket 10 is provided that includes a closable opening 12 in the front that extends from the bottom 14 of the shirt or jacket 10 to the top of the collar or neckline 16. In a preferred embodiment, the closable opening 12 may be closed by a zipper 18. When unzipped, the shirt or jacket is open and each half of the shirt or jacket can be folded to the side permitting access to a patient's neck, chest and stomach. The invention is not limited to the use of a zipper in the front of the shirt or jacket 10. Any comparable fastener could be used, including a hook and loop fastener (such as opposing pieces of fabric, in which one is a dense arrangement of tiny nylon hooks and the other is a dense nylon pile (e.g., VELCRO strips), that interlock when pressed together), buttons, ties, etc. In one embodiment, a two-way zipper can be used that allows closable opening 12 to be zipped from both the top and the bottom. The invention is also not limited to providing such an opening in front center of the shirt/jacket 10. The opening may be provided anywhere, including off center in the front or in the back of the shirt/jacket 10.

The shirt or jacket 10 of this embodiment also includes closable openings 20 and 21 in sleeves 30 and 32. The closable openings 20 and 21 extend from the outer bottom cuffs 26 and 28 of the sleeves 30 and 32 to the necklines 34 and 36 at the outer top sides of the collar, respectively. In the preferred embodiment, closable opening 21 may be closed via a hook and loop fastener, such as two opposing strips of VELCRO 22 and 23 that extend the length of the opening. Likewise, closable opening 20 may be closed via a hook and loop fastener, such as two opposing strips of VELCRO (not shown) that extend the length of the opening. The invention is not limited to the use of a hook and loop fastener to close the closable openings 20 and 21. Any comparable fastener could be used, including zippers, buttons, ties, etc. Also, a combination of different types of fasteners could be used. The invention is not limited to having closable openings in both sleeves. In an alternative embodiment, a closable opening is provided in only one sleeve of the shirt/jacket 10.

In a preferred embodiment, the shirt/jacket 10 is made of a fleece material. The invention is not limited, however, to any particular material. In a preferred embodiment, there is fabric behind the zipper 18 on the inside of the shirt/jacket 10 running from the bottom of the zipper to the neckline to avoid any discomfort by having the zipper lie against a patient's skin. The present invention is not limited to a long sleeve shirt or jacket. While the preferred embodiment shows a mock turtle neck style of collar, the present invention is not limited to any particular collar type. In a preferred embodiment, the shirt/jacket 10 also includes zipper pockets 38 and 39 in the front. The present invention is not limited to any particular style of shirt/jacket 10.

Figure 2:
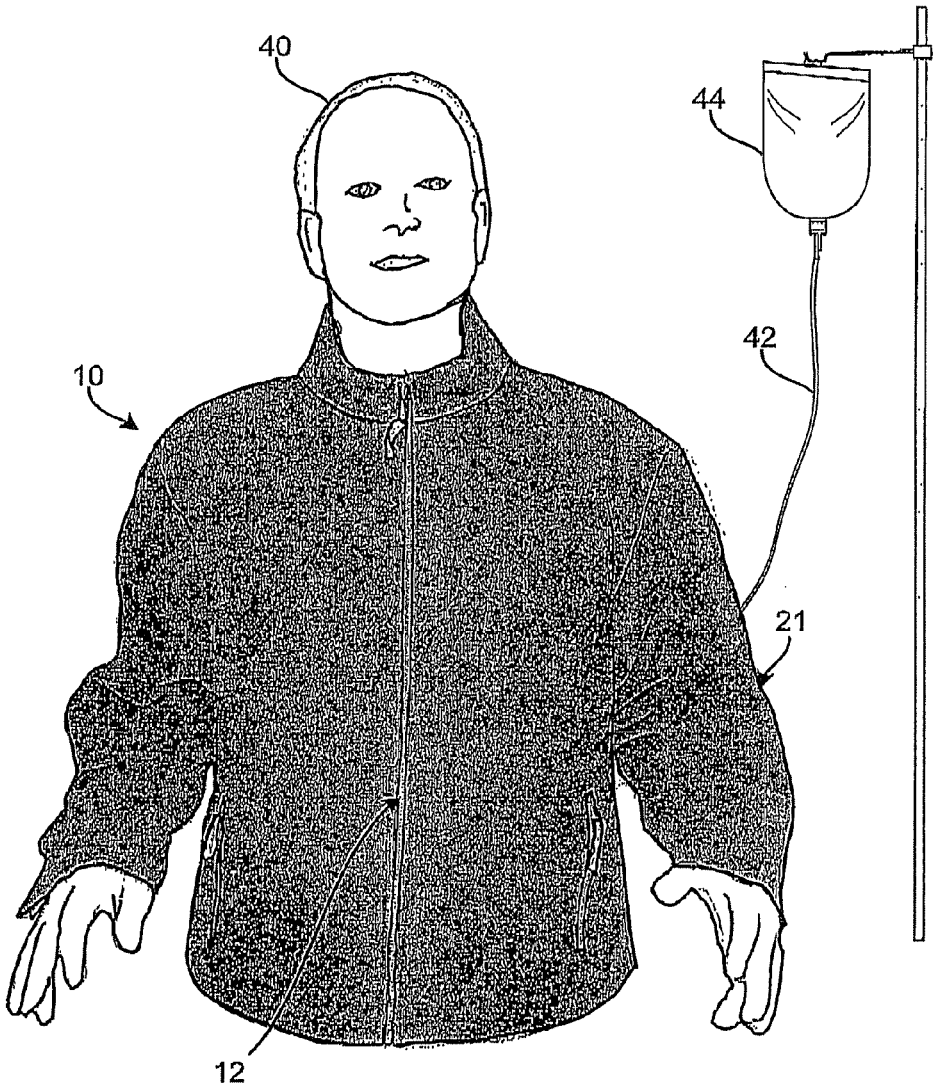
FIG. 2 shows a patient wearing a shirt embodying a preferred embodiment while connected to a drug delivery device.

FIG. 2 shows a patient 40 wearing a preferred embodiment of the shirt/jacket 10 while connected to a drug delivery device. FIG. 2 will be used to illustrate a method of accessing an area on a patient's body for the intravenous delivery of drugs, fluids and/or nutrition supplementation. The patient 40 has an intravenous access device ("IAD") (not shown) inserted in his upper arm. The IAD may be connected via tubing 42 to a bag 44 containing medication, drugs, fluids and/or nutrition supplementation. The IAD may be connected to additional bags containing different medication, drugs, fluids and/or nutrition supplementation. In one embodiment, the IAD is a PICC line through which the patient will be provided chemotherapy.

In a preferred method, a healthcare provider opens the closable opening 21 to gain access to the patient's 40 arm. The healthcare provider inserts an IAD into a vein of patient 40 at one location. In this example, the location is on the patient's arm. The healthcare provider may then connect the IAD via tubing 42 to a bag 44 containing medication, drugs, fluids and/or nutrition supplementation. In a preferred embodiment, the bag 44 is used to provide patient 40 with chemotherapy.

The healthcare provider then closes the closable opening 21 around the tubing 42 and the tubing 42 is routed to extend out of the side of the shirt/jacket 10. In a preferred embodiment, closable opening 21 is closed using fasteners that permit closable opening 21 to remain substantially closed around the tubing 42. For example, a hook and loop fastener using VELCRO strips 22 and 23 shown in FIG. 1 allow the closable opening 21 to remain substantially closed around tubing 42 and cover the patient even when drugs, fluids and/or nutrition supplementation are being provided through the tubing 42. Other comparable fasteners, such as buttons, a two way zipper, ties, etc., can be used. Later, a healthcare provider can open closable opening 21 partially to obtain access to the IAD. A healthcare provider may also partially open closeable opening 21 to obtain access to a different area of the patient's body for a different purpose. For example, a healthcare provider could open closable opening 21 to permit the use of a blood pressure monitor around the patient's arm. A healthcare provider may also completely open closable opening 21 to obtain more access to patient's arm.

In addition, to the extent it is desired to remove shirt/jacket 10 from patient 40, closable opening 21 and closable opening 12 can be opened and the shirt/jacket 10 can be removed from patient 40 without the need to disconnect the IAD from the bag 44 (or any other drug delivery device). A new or clean shirt/jacket 10 can then be put on patient 40, again without the need to disconnect the IAD from bag 44. The method described above is just an example of one embodiment and it should be understood that more or fewer steps may be utilized or the steps may occur in one or more orders that are different from the order of steps described without departing from the spirit of the invention.

While the description above shows the use of one IAD, the invention can be used with multiple IAD devices inserted in different locations accessible when closable opening 21 is opened.

To the extent patient 40 also has an IAD inserted in his or her chest, the tubing from that IAD can be routed either out the front of the shirt/jacket 10 through closable opening 12, out of the neck area of the shirt/jacket 10 or out closable opening 20 or 21 through either the shoulder area or the arm area. A healthcare provider can obtain access to the patient's 40 chest area to insert or interact with an IAD in several ways. For example, the healthcare provider can open a portion of closable opening 21 (or 20) starting at the neckline 46. Alternatively, the healthcare provider can access the patient's chest by opening a portion of closable opening 12. As yet another alternative, the healthcare provider can open portions of both closable openings 12 and 21 (or 20).

Figure 3:
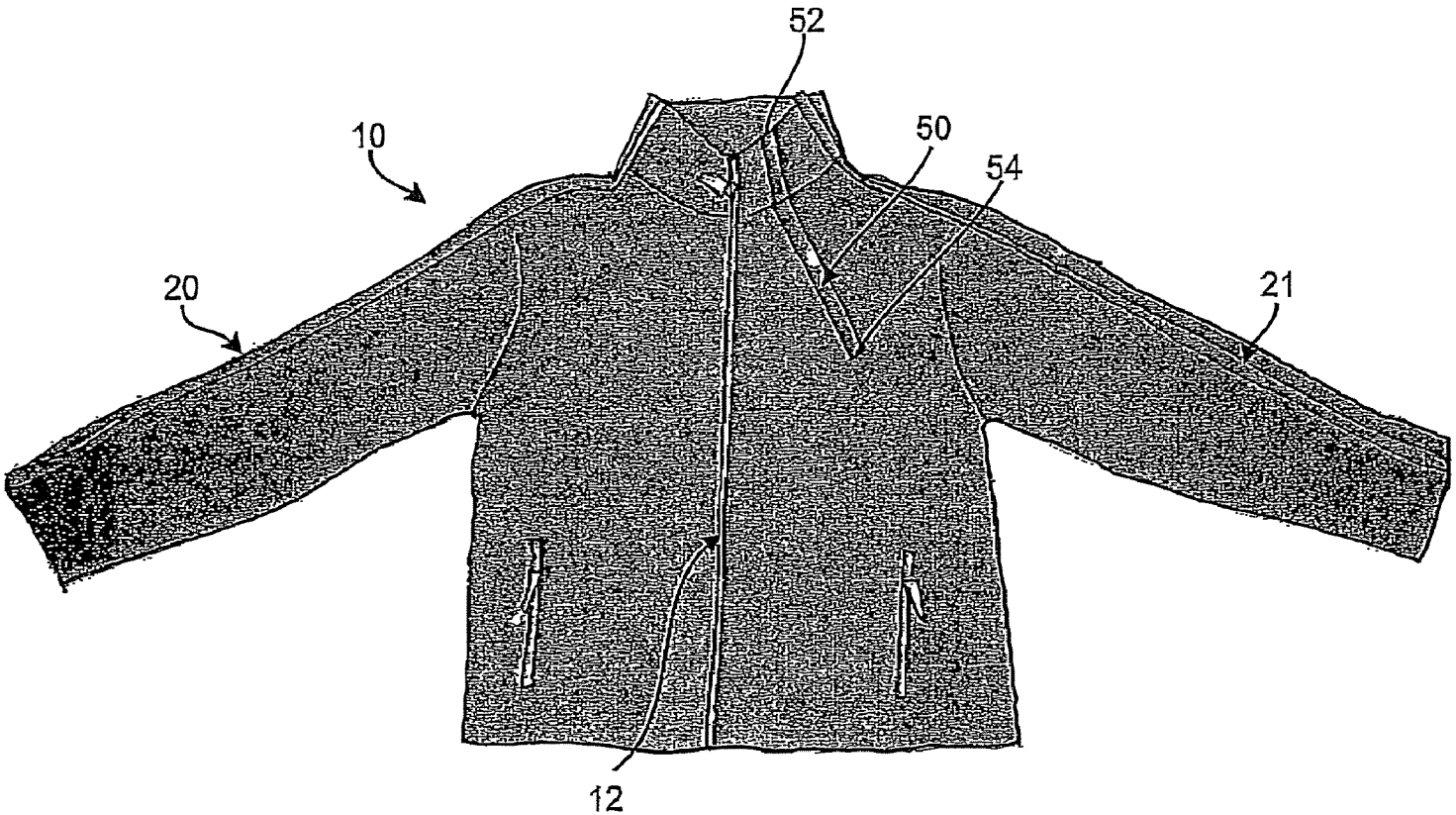
FIG. 3 shows a front view of a shirt embodying an alternative embodiment of the invention.

FIG. 3 shows an alternative embodiment in which an additional opening is provided to allow access to the patient's 40 chest area. In this embodiment, a closable opening 50 extends from the neckline collar 52 of shirt/jacket 10 to a point 54 that is around the chest area of a patient. In a preferred embodiment, closable opening 50 is provided on one side of the shirt/jacket 10 between closable opening 12 and closable opening 21. The closable opening 50 may be closed via a hook and loop fastener such as two opposing strips of VELCRO that extend the length of the opening. The invention is not limited to the use of a hook and loop fastener to close the closable opening 50. Any comparable fastener could be used, including zippers, buttons, ties, etc. Also, a combination of different types of fasteners could be used. Closable opening 50 preferably extends diagonally from the neckline 52 to point 54. The invention of this alternative embodiment is not limited to any particular orientation of the closable opening 50. In an alternative embodiment, a similar opening can be provided on the other side of the shirt/jacket 10 between opening 12 and opening 20. While FIG. 3 also shows closable openings 20 and 21 in the sleeves of the shirt/jacket 10, in another embodiment there are no such openings in the sleeves of the shirt/jacket 10.

When using the alternative embodiment shown in FIG. 3, a healthcare provider can open the closable opening 50 to gain access to the patient's 40 chest. The healthcare provider can insert an IAD into the patient's chest and connect that IAD via tubing to one or more bags containing medication, drugs, fluids and/or nutrition supplementation. The healthcare provider may then close the closable opening 50 around the tubing and the tubing can be routed to extend out of the front of the shirt/jacket 10 through closable opening 50. The hook and loop fastener or comparable fastener preferably allow the closable opening to remain substantially closed around the tubing and cover the patient even when drugs, fluids and/or nutrition supplementation are being provided to the patient.

Later, a healthcare provider can open closable opening 50 to obtain access to the patient's chest. A healthcare provider may also open closeable opening 50 to obtain access to an IAD or to the patient's chest for a different purpose. For example, a healthcare provider could open closable opening 50 to permit the use of a stethoscope to listen the patient's breathing or heartbeat. A healthcare provider may also open closable opening 50 and at least a portion of closeable opening 21 to obtain more access to patient's chest and shoulder area. In addition, to the extent it is desired to remove shirt/jacket 10 from patient 40, closable openings 12 and 50 can be opened and the shirt/jacket 10 can be removed from patient 40 without the need to disconnect any IAD in the patient's chest and/or arm from a drug delivery device (e.g., bags). A new or clean shirt/jacket 10 can then be put on patient 40, again without the need to disconnect any such IAD.

It should be understood that the above description of the preferred embodiment, alternative embodiments and specific examples are given by way of illustration and not limitation. Many changes and modifications may be made without departing from the spirit of the invention, and the present invention includes all such changes and modifications. For example, the invention is not limited to placing closable openings in a particular location. Similarly, the invention is not limited to methods that utilize all of the steps disclosed herein or steps in the same order disclosed herein.

We claim:

1. An article of clothing of an adult patient made of outer garment material for covering at least a portion of the patient's upper body and for use when the patient is receiving medical treatment, comprising:

a front portion for covering at least a portion of the patient's chest and stomach;

a first sleeve connected to the front portion for covering at least a portion of an arm;

a collar connected to the front portion and the first sleeve;

a first closable opening in the front portion extending the entire length of the front portion from a bottom of the front portion to the collar;

a closable opening in the first sleeve that extends the entire length of the first sleeve from an outer bottom cuff of the first sleeve to a first side of the collar;

a first fastener for opening and closing the first closable opening;

a fastener in the first sleeve for opening and closing the closeable opening in the first sleeve, wherein the fastener in the first sleeve permits the closable opening in the first sleeve to be substantially closed around a first tube connected to a first intravenous access device;

a second closeable opening in the front portion extending from a top location in the collar to a bottom location in the front portion that would cover a patient's chest wherein the top location in the collar of the second closeable opening is between the location in the collar of the first closeable opening and the first side of the collar; and a second fastener for opening and closing the second closeable opening, wherein the second fastener permits the second closeable opening to be substantially closed around a third tube connected to a second intravenous access device;

wherein the article of clothing may be removed from the adult patient without requiring the removal of either the first or second intravenous access device.

2. The article of clothing of claim 1 wherein the fastener in the first sleeve comprises a hook and loop fastener.

3. The article of clothing of claim 1 further comprising a second sleeve connected to the front portion and the collar for covering at least a portion of a second arm.

4. The article of clothing of claim 3 further comprising:

a closeable opening in the second sleeve extending the length of the second sleeve from an outer bottom cuff of the second sleeve to a second side of the collar;

a fastener in the second sleeve for opening and closing the closeable opening in the second sleeve, wherein the fastener in the second sleeve permits the closable opening in the second sleeve to be substantially closed around a third tube connected to a third intravenous access device.

5. The article of clothing of claim 4 wherein the fastener in the second sleeve comprises a hook and loop fastener.

6. The article of clothing of claim 1 wherein the first fastener comprises a zipper.

7. The article of clothing of claim 1 wherein the article of clothing comprises a sweatshirt jacket.

8. The article of clothing of claim 1 wherein the first sleeve extends the entire length of the patient's arm.

9. The article of clothing of claim 1 wherein the second closable opening in the front portion extends diagonally from the top location to the bottom location.

10. The article of clothing of claim 1 wherein the outer garment material comprises fleece.

11. A method for accessing an area on an adult patient's upper body for treatment while permitting the patient to wear a comfortable shirt comprising a first sleeve having a bottom cuff, a front portion, and a collar, the method comprising:

opening at least a portion of a closeable opening in the first sleeve of the shirt that extends the length of the first sleeve from the bottom cuff of the first sleeve to a side of the collar, wherein the first sleeve covers at least a portion of a first arm of the patient;

accessing an intravenous access device located on the first arm;

connecting the intravenous access device to tubing for receiving drugs, fluids or nutrition from a drug delivery device;

passing the tubing through the closeable opening in the first sleeve;

substantially closing the closeable opening in the first sleeve around the tubing;

opening at least a portion of a first closeable opening in the front portion of the shirt that extends from a top location in the collar to a bottom location in the front portion that covers an area of the patient's chest;

accessing the area of the patient's chest exposed by opening the first closeable opening;

opening a second closeable opening in the front portion of the shirt that extends the entire length of the front of the shirt from the bottom to a first location in the collar wherein the top location in the collar from which the first closeable opening extends is located between the first location in the collar of the second closeable opening and the side of the collar to which the closeable opening in the first sleeve extends;

opening the second closeable opening in the first sleeve; and removing the shirt from the patient without disconnecting the tubing from intravenous access device.

12. The method of claim 11 wherein the closeable opening in the first sleeve is opened and closed using a hook and loop fastener.

13. The method of claim 11 wherein the second closeable opening in the front portion is opened and closed using a zipper.

14. A method for accessing an area on an adult patient's upper body for treatment while permitting the patient to wear a comfortable shirt comprising a first sleeve having a bottom cuff, a front portion, and a collar, the method comprising:

opening at least a portion of a first closeable opening in the front portion extending from the collar to a location in the front portion that covers a chest area of the patient;

accessing an intravenous access device located on the chest area of the patient;

connecting the intravenous access device to tubing for receiving drugs, fluids or nutrition from a drug delivery device;

passing the tubing through the first closeable opening in the front portion;

substantially closing the first closeable opening in the front portion around the tubing;

opening at least a portion of a closeable opening in the first sleeve of the shirt that extends the length of the first sleeve from the bottom cuff of the first sleeve to a side of the collar, wherein the first sleeve covers at least a portion of a first arm of the patient;

accessing an area on the first arm of the patient;

opening a second closeable opening in the front portion of the shirt that extends the entire length of the front of the shirt from the bottom to a first location in the collar, wherein the first closeable opening extends from a second location in the collar that is between the first location and the side of the collar to which the closeable opening in the first sleeve extends;

opening the first closeable opening in the front portion of the shirt; and removing the shirt from the patient without disconnecting the tubing from the intravenous access device.

15. The method of claim 14 wherein the first closeable opening in the front portion is opened and closed using a hook and loop fastener.

16. The method of claim 14 wherein the second closeable opening in the front portion is opened and closed using a zipper.

* * * * *